United States Patent [19]

Vann

[11] Patent Number: 4,499,951

[45] Date of Patent: Feb. 19, 1985

[54] BALL SWITCH DEVICE AND METHOD

[75] Inventor: Roy R. Vann, Odessa, Tex.

[73] Assignee: GEO Vann, Inc., Houston, Tex.

[21] Appl. No.: 493,018

[22] Filed: May 9, 1983

Related U.S. Application Data

[63] Continuation of Ser. No. 175,515, Aug. 5, 1980, abandoned.

[51] Int. Cl.[3] ..... E21B 43/11

[52] U.S. Cl. ..... 166/297; 166/55.1; 166/296; 166/317; 175/4.54

[58] Field of Search ..... 175/4.54–4.56, 175/4.51–4.53; 166/296, 297, 295, 55.1, 55, 63; 102/319–321, 323, 310–313

[56] References Cited

U.S. PATENT DOCUMENTS

| | | | |
|---|---|---|---|
| 2,749,840 | 6/1956 | Babcock | 102/319 |
| 2,760,408 | 8/1956 | Taylor | 175/4.54 |
| 2,762,440 | 9/1956 | Reed | 166/290 |
| 2,947,363 | 8/1960 | Sackett et al. | 166/318 |
| 3,713,490 | 1/1973 | Watson | 166/318 |
| 3,990,507 | 11/1976 | Vann | 166/63 |
| 4,299,287 | 11/1981 | Vann et al. | 166/318 |

*Primary Examiner*—William F. Pate, III

[57] ABSTRACT

A tubing string extends downhole in a cased borehole to a jet perforating gun. A packer device is located uphole of a releasable coupling apparatus. The coupling apparatus has an annular piston therein which is moved to release the lower string. Two spaced apart movable annular pistons are series connected in the tubing string at a location below the packer and above the gun. Flow ports, formed in the tubing wall, are covered by the pistons. A ball of appropriate diameter can be circulated downhole and seated upon either of the pistons, thereby forcing a selected piston in a downhole direction. Circulation ports are provided below the lower piston in proximity of a gun firing head. The lower piston includes a shaft depending axially therefrom and into proximity of a detonator of the gun firing head, so that when the lower piston is forced downhole, the shaft contacts the firing head which detonates the shaped charges of the perforating gun. This assembly of elements enables many different options to be exercised prior to firing the gun.

34 Claims, 9 Drawing Figures

BALL SWITCH DEVICE AND METHOD

This is a continuation of application Ser. No. 175,515, filed Aug. 5, 1980 abandoned.

BACKGROUND OF THE INVENTION

In my previous U.S. Pat. No. 3,706,344, there is disclosed a perforating gun which is detonated by dropping a bar down the tubing string. The bar impacts against a firing head which detonates the shaped charges of the gun. Once the bar has been dropped down the tubing, the system is committed to proceed with the final completion steps.

Often it is desirable to install the perforating gun while various workover equipment is on hand, and to complete the well at some subsequent date. This effects a considerable savings in money and also provides a means for isolating the hydrocarbon containing zone so that the well can remain dormant until the subsequent completion date arrives. During this time, there is always a danger of some objects being accidently dropped downhole and inadvertently firing the gun and completing the well without the necessary surface equipment and technical people being on hand. Moreover, during a long interval of time, it is possible for debris to collect above the firing head so that when the bar is subsequently dropped in order to attempt completing the well, the overlying debris prevents the bar from contacting the firing head, and the perforating gun cannot be fired.

There are many highly deviated boreholes slanted towards the horizontal to an extent which precludes the use of gravity induced impact for firing a perforating gun. In this instance, some means, other than a bar, must be employed for detonating the gun. This is especially so in offshore rigs where multiple boreholes are formed by slanting each of the wells away from a single drilling platform, thereby radially spacing the wells respective to one another.

In my previous U.S. Pat. Nos. 3,966,236 and 4,066,282, it is pointed out that one can often foresee that a tool string located on the lower marginal end of a tubing string must be subsequently disconnected from the remainder of the string and abandoned downhole in the wellbore. It is especially important when running tool strings into expensive offshore wells to be able to assure everyone concerned that should the string become stuck downhole, that provisions are included for releasing the stuck part of the tool string.

As pointed out in my previously issued U.S. Pat. No. 3,706,344, it is advantageous to be able to complete a well while the tubing string is open to ambient so that a maximum pressure differential is achieved across the production formation instantaneous with the perforation thereof so that the debris is immediately flushed out of the newly completed formation, thereby avoiding any contamination of the production zone with extraneous material.

It would be desirable to be able to circulate fluid downhole and across the firing head of a gun in order to wash debris therefrom. It would also be desirable to be able to open the main vent assembly of the tubing simultaneously with the actuation of the firing head. It would further be desirable to protect the firing head of the perforating gun prior to detonation thereof. Moreover, several heretofore unknown advantages would be realized if one were able to increase and then decrease the circulation rate of the lower borehole annulus, and to be able to close off the lower tubing string, or to open the lower tubing string at any time prior to detonation of the gun. It would furthermore be desirable to be able to fire the gun while the tubing string is vented to ambient at the surface of the ground.

Apparatus and method which enable the above desirable manipulations to be performed while completing a cased wellbore is the subject of the present invention.

SUMMARY OF THE INVENTION

A ball switch device and method which enables a hydrocarbon bearing formation to be perforated and the borehole completed in a new and unobvious manner so that unusual and unexpected results are attained thereby. The apparatus of the present invention includes a tubing string having the lower end thereof connected to a perforating gun. A packer device is interposed between the casing and tubing to divide the casing annulus into an upper and lower annular area. The packer device is located uphole of a releasable coupling apparatus. An annular piston is slidably moved downhole to effect release of the releasable coupling apparatus so that the entire lower tool string can be abandoned downhole in the borehole.

The gun preferably is a large casing gun having a firing head arranged to be detonated by impact with an object which has been circulated downhole through the tubing string.

Two additional spaced apart movable annular pistons are series connected in the tubing string in underlying relationship respective to the releasable coupling. The perforating gun is disposed downhole of the lowermost piston. Flow ports, formed at spaced locations along the tubing wall, are covered by the pistons. Each piston has an axial passageway formed therethrough. The passageways of the three pistons diminish in diameter in a downhole direction. Balls of selected diameters can therefore be circulated downhole into seated relationship respective to a specific piston. A large ball, for example, will become seated on the piston of the releasable coupling apparatus to effect release thereof, while a smaller ball can flow axially through both of the upper piston passageways and come to rest in seated relationship on the lower piston. An intermediate size ball, on the other hand, will pass through the uppermost piston and become seated on the intermediate or second piston.

Circulation ports are provided below the lowermost piston in proximity of a gun firing head. The lowermost piston includes a shaft depending axially downhole therefrom and into proximity of a detonator of the gun firing head, so that when the lower piston is forced downhole, the shaft contacts the firing head which detonates the shaped charges of the perforating gun. This assembly of elements enables many different options to be exercised prior to the firing of the gun.

This invention enables a small outside diameter ball to be circulated down through the tubing string, through the upper passageway of the upper and intermediate pistons, and into seated position on the lowermost piston. Thereafter, fluid pressure is effected within the tubing string to force the lower piston to move in a downward direction and detonate the shaped charges of the perforating gun.

At any time before the gun is fired, an intermediate size ball can be circulated downhole and into seated position on the second piston to thereby obstruct the lower tubing string to prevent debris from accumulating therebelow, and wherein pressure effected above said ball and within said tubing string forces the second piston to move in a downward direction, thereby opening the upper ports.

Should a malfunction occur, or should the lower part of the tool string become stuck downhole, a relative large ball can be circulated downhole to actuate the releasable coupling. This enables retrieval of all of the string located above the releasable coupling.

Therefore, the above well completion apparatus enables the following method to be achieved.

An appropriate size ball can be placed on the second seat, thereby preventing access to the firing head of the perforating gun. Reverse circulation thereafter removes the ball along with any debris that may have accumulated about the gun firing head.

With the ball retrieved, circulation can occur down through the tubing string and through the lowermost ports, thereby forcing any debris which may have accumulated about the gun head to be washed up the borehole annulus and to the surface of the ground.

The above ball can be circulated downhole onto the second piston, and thereafter pressure effected on the tubing interior to move the piston in a downward direction, whereupon the upper ports are uncovered and circulation occurs through the uppermost ports. Thereafter reverse circulation retrieves the ball and the perforating gun can be detonated by driving the lower piston in a downward direction with a bar in order to detonate the gun if the hole is not unduly slanted.

With the second and third pistons covering their respective ports, a relatively small o.d. ball can be circulated downhole through the tubing, through the upper piston, through the second piston, where the ball lands on the seat of the lowermost piston, thereby driving the lower piston in a downward direction to detonate the gun and simultaneously open additional vent or circulation ports so that production can occur back uphole to the surface of the ground. This last port can be eliminated as another embodiment of this invention.

Accordingly, a primary object of the present invention is the provision of improvements in apparatus and method for completing a hydrocarbon producing formation.

A further object of this invention is the provision of method and apparatus which enables the firing head of a gun to be protected until a well is completed, and during completion of the well, the apparatus may be used to open additional circulating ports while simultaneously detonating a perforating gun.

A still further object of this invention is the provision of method and apparatus for completing slanted boreholes by effecting fluid pressure internally of a tool string located within the borehole.

Still another object of this invention is the provision of method and apparatus by which objects may be circulated into and out of a tool string located in a slanted borehole so as to complete the well and subsequently retrieve the tubing along with part of the tool string.

The above objects are attained in accordance with the present invention by the provision of a tubing string disposed within a cased borehole, with a perforating gun attached at the lower end of the tubing string, and two spaced annular pistons located above a gun firing head of the perforating gun, with each piston covering a vent, so that a ball of a small diameter can be circulated down through the tubing string to open the lower piston and fire the gun, or a ball of a large diameter can be circulated downhole to open the upper piston.

These and various other objects and advantages of the invention will become readily apparent to those skilled in the art upon reading the following detailed description and claims and by referring to the accompanying drawings.

DETAILED DESCRIPTION OF THE PREFERRED EMBODIMENTS

Figure 1:
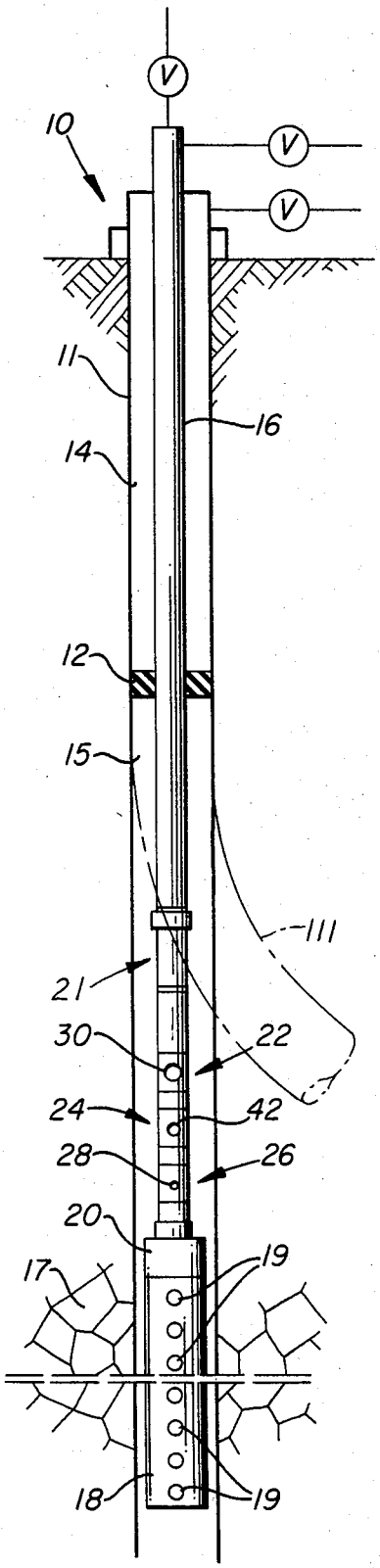
FIG. 1 is a diagrammatical, cross-sectional, hypothetical view of a wellbore extending downhole into the ground with apparatus made in accordance with the present invention being disclosed in conjunction therewith.

In FIG. 1, there is schematically illustrated a wellhead 10 located at the upper end of a borehole having a casing 11 therewithin. Packer 12 separates the upper borehole annulus 14 from a lower borehole annulus 15. Tubing 16 extends from the wellhead, downhole to a jet perforating gun 18 located in proximity of a hydrocarbon bearing formation 17. The well may extend vertically downward into the earth as seen at 11, or the borehold can be slanted as indicated at 111 in FIGS. 1 and 7.

The perforating gun preferably is a large casing gun having shaped charges 19 which are detonated by a firing head 20. The firing head is responsive to impact, and the details thereof are more fully set forth in my previously issued U.S. Pat. No. 3,706,344. The tubing string includes subs 21, 22, 24, and 26, the details of which are more fully disclosed in other figures of the present drawings.

Figure 3:
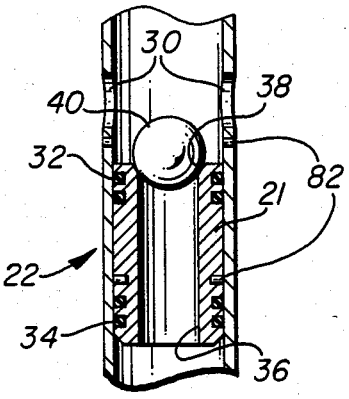
FIG. 3 illustrates the apparatus of FIG. 2 in another operative configuration.
Figure 4:
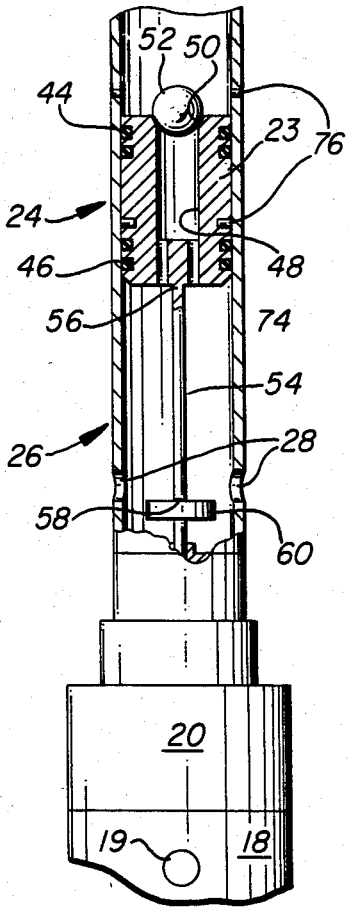
FIG. 4 illustrates the apparatus of FIG. 2 in still another operative configuration.
Figure 2:
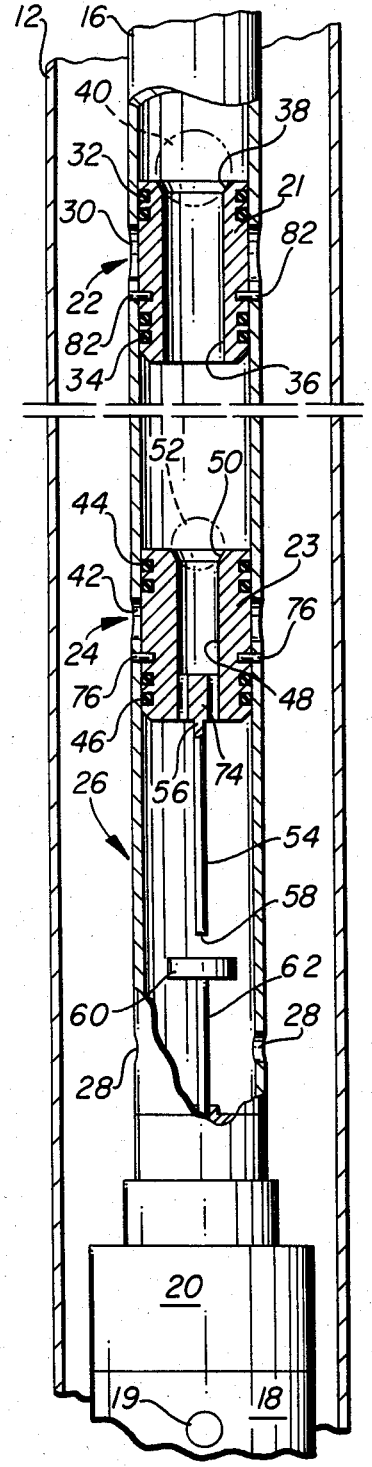
FIG. 2 is a fragmentary, enlarged, part cross-sectional, schematical-type view of part of the apparatus disclosed in FIG. 1.

As seen illustrated in FIGS. 2 and 4, a lower circulation port 28 of relatively small diameter is located in close proximity of the firing head of the gun so that circulation can be effected therethrough. This action removes debris from the upper end of the gun firing head. As seen in FIGS. 1–3, the tubing wall has a relatively large diameter upper port 30 which is sealingly closed by an annular piston 21. The piston includes spaced seals, 32 and 34, circumferentially extending thereabout and sealing the interface formed between the exterior of the piston and the interior wall surface of the tubing. An axial passageway 36 of a specific relative diameter extends longitudinally through the piston. The piston passageway is formed into a seat 38 at the upper marginal end thereof against which a ball of a specific outside diameter can be seated so that the piston 21 can be circulated or forced to move in a downward direction in order to uncover the upper ports 30 in accordance with the present invention.

Radially spaced apart ports or vents 42 are of a specific relative size respective to vents 30 and 28. The vents 42 are located below the upper vents 30 and above the lower vents 28. The middle vents are covered by annular piston 23. Circumferentially extending seals 44 and 46 seal the interface between the exterior of the lower piston and the interior of the tubing string. Axial passageway 48 terminates in a lower seat 50 located at the upper end of the piston 23 and sealingly receives a relatively small o.d. ball 52 in seated relationship thereagainst.

A firing rod 54 is axially aligned longitudinally with respect to the tubing string and includes a fixed end 56 which is affixed to the lower end of piston 23. The firing rod downwardly depends from the piston and terminates at a free end 58. Passageway 48 communicates with ports 28 by means of the radial passageways formed through the lower end of the annular piston.

Piston 23 can be forced to slide in a downward direction relative to the tubing interior, whereupon the free end of the firing rod impacts against the trigger device 60 of the firing head. This action moves the trigger rod 62 in a downward direction, whereupon detonation of the perforating gun occurs. The presence of intermediate ports 42 in FIGS. 1 and 2, and the absence of these ports from FIG. 4 shows that different embodiments of the invention are illustrated herein.

Figure 5:
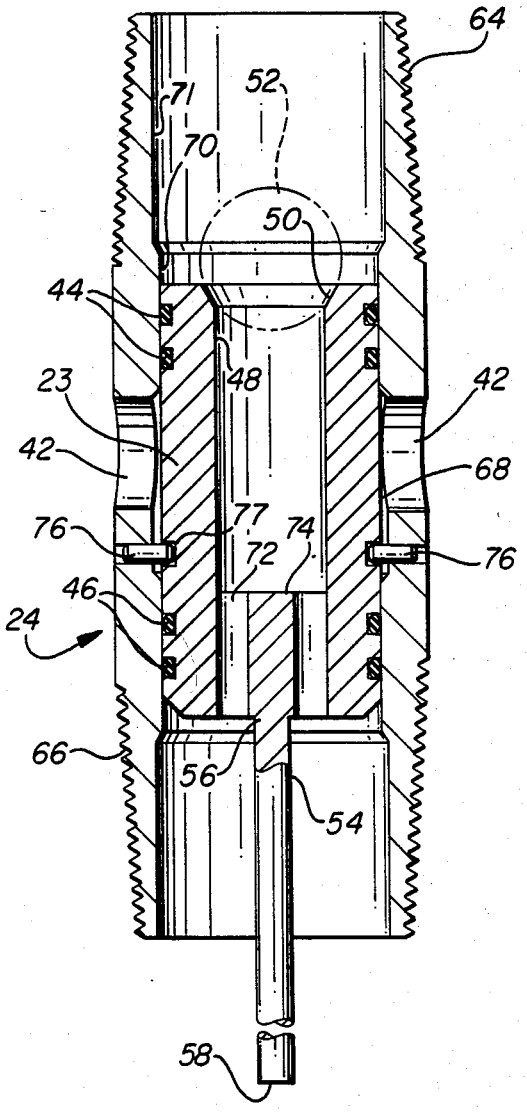
FIG. 5 sets forth an enlarged detail of part of the apparatus seen in the foregoing figures.

In FIG. 5, there is set forth the details of one of the subs. The sub 24 is provided with threads 64 and 66 at the opposite marginal ends thereof so that the sub can be threadedly made-up into the tubing string. The piston has an o.d. 68 which enables it to be slidably received in close tolerance relationship within the reduced inside diameter 70 of sub. The i.d. of the sub increases at 71 from the nominal i.d. of the lower tubing string.

The lower end of the piston is provided with the before mentioned radially spaced apart circulation ports 72 which are arranged circumferentially about the longitudinal axial centerline of the sub, and parallel to the axial centerline of the tubing string, with there being ample material at 74 for transfer of loads which may be imposed upon the before mentioned firing rod. Shear pin 76 is received within the illustrated groove 77 and ridgedly captures the piston within the sub until sufficient force is exerted upon the piston to shear the pins. The ports 42 are smaller than ports 30, or may be excluded from the apparatus.

Figure 6:
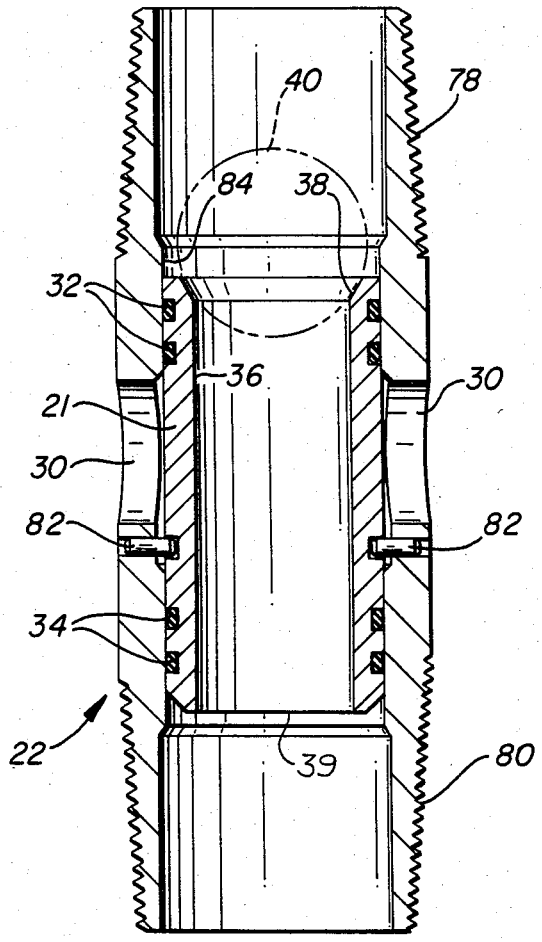
FIG. 6 sets forth an enlarged detail of another part of the apparatus disclosed in the foregoing figures.

In FIG. 6, wherein the details of the sub 22 are more fully disclosed, the axial passageway 36 of piston 21 is unrestricted to provide for movement of the relative small i.d. ball therethrough. The sub 22 is threaded at each marginal end 78 and 80 thereof for attachment in series relationship within the tubing string. Shear pin 82 rigidly affixes the piston within the small i.d. portion 84 of the sub.

The interface between the piston and the inside surface 84 is sealed by the o-rings 32. The lower circumferentially extending edge 39 of the annular piston which is opposed to the seat 38 can be engaged by a fishing tool should it ever become necessary to move the piston in an uphole direction respective to the sub.

Figure 7:
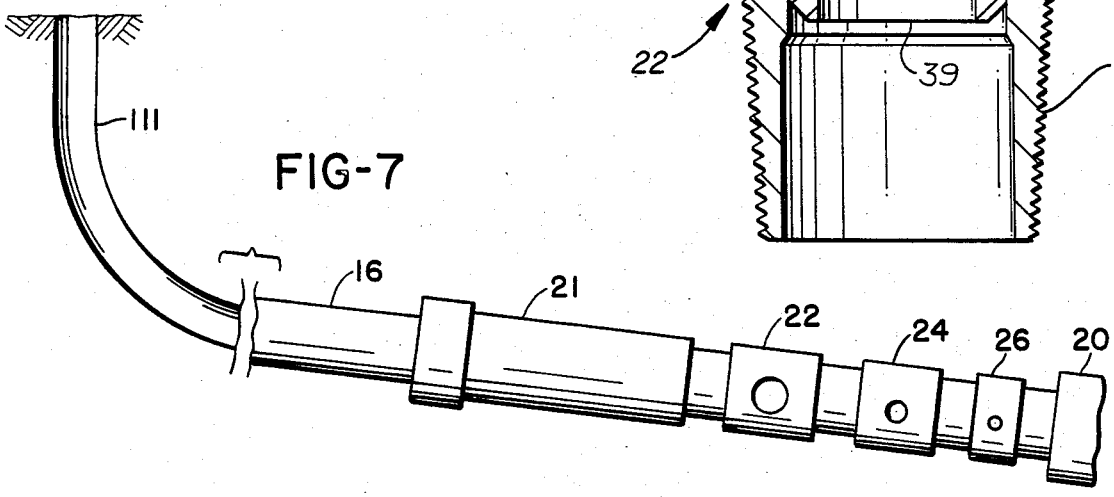
FIG. 7 is a broken view of the present invention disclosed in conjunction with a slanted borehole.

In FIG. 7, the borehole is severely slanted as noted at 111. The tool string of FIG. 7 is identical to the tool string illustrated in FIGS. 1–6.

Figure 8:
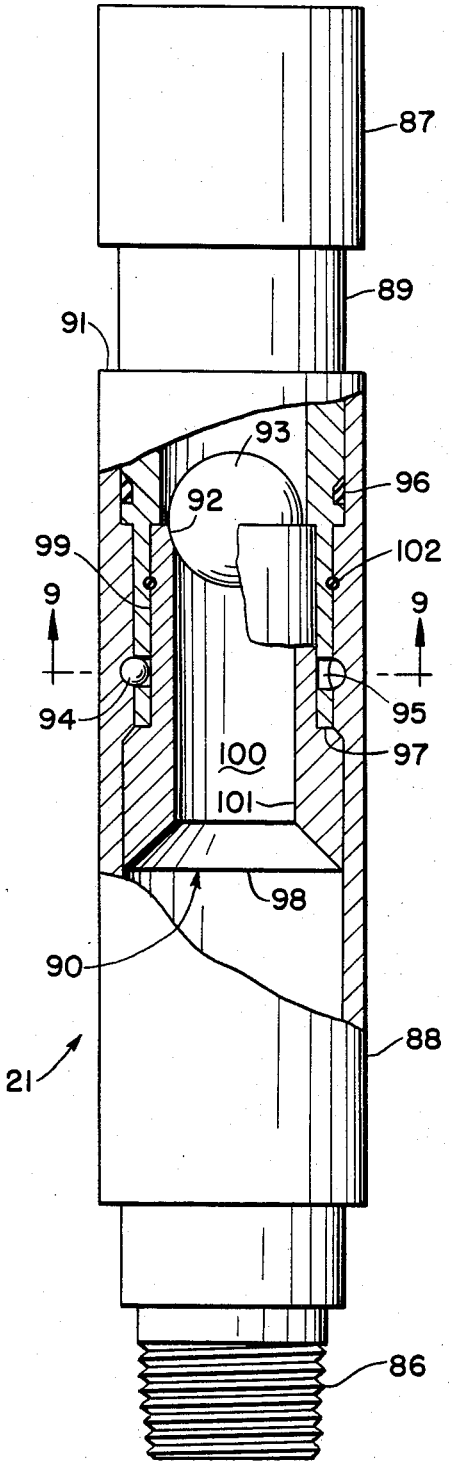
FIG. 8 is an enlarged view of part of the apparatus disclosed in FIGS. 1 and 7; and, FIG. 9 is a cross-sectional view taken along line 9—9 of FIG. 8.
Figure 9:
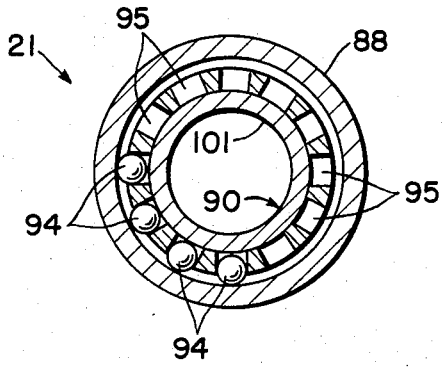

In FIGS. 8 and 9, the details of the releasable coupling apparatus 21 is more fully disclosed. The coupling apparatus includes a pin end 86 opposed to a box end 87. An outer barrel 88 slidably receives an inner mandrel 89 in sealed, releasable relationship therewithin.

The barrel and mandrel are released from one another by movement of releasing annular piston 90, which is the uppermost piston of the tool string. The barrel has one end 91 opposed to the pin end 86.

The releasing piston has a seat 92 which receives a relative large ball 93 in seated relationship thereon. A plurality of radially spaced releasing balls 94 are fitted into annular groove 95 jointly formed within the wall of the mandrel and barrel.

Seal 96 prevents fluid flow between the co-acting marginal end portions of the mandrel and barrel. The mandrel includes a skirt which terminates at circumferentially extending edge portion 97, while the releasing piston terminates at 98. The skirt has an axial bore 99 which slidably receives piston 90, while the piston has an axial bore 100 which is of smaller diameter 101 as compared to the i.d. of the tubing string.

In operation, the gun is attached to the end of tubing string 16, the packer is interposed in the tubing string, and the subs 21, 22, 24, and 26 are series connected therein. Care must be taken that sub 26 is arranged such that the small ports 28 are located to cause any acumulated debris to be washed from about the firing trigger rod 62. The location of sub 24 must be such that piston 23 is positioned to cause the depending end 58 of rod 54 to contact the firing head trigger enlargement 60 when the piston 23 is forced downhole.

The axial piston passageways 36, 48, and 100, and the balls 40, 52, and 93, must be of a size whereby balls 93, 40, and 52, respectively, are seated on top of pistons 90, 21, and 23, respectively; while ball 52 can pass through passageway 36 and become seated on top of piston 23; and ball 40 can pass through passageway 100 and become seated on top of piston 21. The spaced distance between rod end 58 and trigger end 60 must also be selected so that there is no question of the gun improperly detonating when the lower piston is moved in a downward direction.

Assuming that the cased borehole extends vertically or horizontally through a pay zone 17, that packer 12 is set, and that gun 18 is properly positioned adjacent to the pay zone, and that the subs 21, 22, 24, and 26 are properly positioned within the tubing string; those skilled in the art will now appreciate that an intermediate size ball 40, when circulated through the tubing string, will pass through the annular piston of the releasable coupling and come to rest in the dot-dash position seen illustrated at 40 in FIG. 2 or 3. The entire system is now in the standby configuration, ready for the gun to be detonated, whenever it is desired to do so; but, at the same time, the gun firing mechanism is safe from inadvertently being fired because of the presence of the large ball 40 located on seat 38. Moreover, debris which may inadvertently fall down tubing 16 is precluded from lodging about the firing head trigger device. The well can remain in this configuration until it is desired to complete the well and tie the production into a gathering system. The task of completing the well at some subsequent date has been greatly simplified, and the wellbore and production apparatus is rendered safe during the intervening time interval.

Prior to perforating casing 11, ball 40 is circulated out of the tubing string by means of reverse circulation through small ports 28. At this time, several options are available to the technician as follows:

(1) Circulation down through the tubing string may be effected to clean debris from the borehole.

(2) A small ball 52 can be dropped down the tubing string. Thereafter, small ball 52 can be retrieved by reverse circulation; or alternatively, the ball may become seated on piston 23, and pressure applied to the tubing interior whereupon the pin 76 is sheared, thereby moving piston 23 downhole to detonate the gun, thus completing the well.

(3) Instead of carrying out (2), the large ball 40 can again be circulated downhole, the piston 21 engaged, the pins 82 sheared, and the large ports 30 uncovered, thereby enabling a very large circulation in either direction to occur above the piston 21 and through the large ports 30.

(4) After the ball 40 has been dropped, and before the piston 21 has been actuated, ball 40 can be retrieved by reverse circulation as pointed out above.

(5) Small ball 52 can be dropped onto seat 50, thereafter large ball 40 can be dropped onto seat 38, pressure can be applied to the tubing interior, thereby simultaneously moving both pistons 21 and 23 downhole, detonating the casing gun, and completing the well with production simultaneously occurring through ports 28, 42, and 30, assuming ports 42 are selected to be formed within sub 24.

(6) After piston 21 has been moved downhole by ball 40, it is possible to retrieve the ball by reverse circulation and thereafter reposition piston 21 using a wireline operated fishing tool, so that either of steps (2) or (5) can thereafter be carried out.

(7) Following step (3), the gun can be detonated by dropping a bar down through the tubing string if the borehole is not unduly slanted.

At any time, should it become necessary to do so, the largest ball 93 can be circulated downhole onto seat 92 of piston 90, to force the annular piston downhole causing the releasing balls 94 to fall from the annular ball receiving groove 95. This action enables the mandrel to slidably part from the barrel, whereupon the tubing string and part of the tool string can be removed from the borehole, leaving the lower end of the tool string in the bottom of the borehole. Hence, there is no danger of some unforeseen malfunction causing the hole to be abandoned. The remainder of the tool string can be removed by fishing experts, if desired, or the lower formation repenetrated using a whipstock.

Further details of apparatus similar to the releasable coupling 21 are found in my issued U.S. Pat. Nos. 4,078,611; 4,066,282; 3,990,507; 3,966,236; and 3,912,013 to which reference is made.

Further details of other vent assemblies and the problems associated therewith are set forth in my issued U.S. Pat. Nos. 4,151,880; 4,040,485; 3,931,855; and 3,871,448.

Hence, the present combination of elements enables a number of choices of downhole manipulations to be carried out in a low cost manner during the well completion operation.

In the preferred method of completing a well, clean, clear water partially fills the lower annulus 15, with there being compressible gas located under the seated packer 12. Ball 40 is seated on piston 21 until is is desired to complete the well. At this time, the ball 40 is retrieved by reverse circulation after unlatching packer 12 so that fluid flow can occur in a reverse direction through small ports 28, thereby carrying ball 40 back to the surface and cleaning any debris from about the firing head of the gun. Either liquid or gas can be used for this operation. The packer 12 is reset, fresh water is pumped down tubing 16 to provide a hydrostatic head on the gun, and gas is again compressed under the packer. The small ball 52 is circulated or dropped downhole and becomes seated on top of piston 23, nitrogen or water is then pumped into tubing 16, causing shear pin 76 to fail, whereupon piston 23 moves downhole, engages and moves the detonator rod 60, 62; and at the same time intermediate vent 42 is opened. This enables the hydrocarbons to rush through the newly formed perforations, into the lower borehole annulus, into vent ports 28 and 42, and uphole to the surface of the earth.

By initially conducting the formation pressure across the minimum available pressure drop, that is, by flowing the new pay zone directly to ambient, the perforations are cleaned up and all contaminants removed from the pay zone. This provides a superior production formation which is more economical to produce and which is subject to less remedial action at a subsequent time.

Proper adjustment of the relative positions of the vent ports 42, piston 23, rod end 58, and trigger rod 60 will render the system such that it is impossible to fire the gun until after the piston has commenced to move, with these two actions occurring substantially simultaneously respective to one another.

In an extreme instance when a large circulation must be employed to clean out the borehole, the upper large vent 30 can be opened, and thereafter a bar used to force the piston 23 or both pistons 21 and 23 downward to detonate the gun.

After the shaped charges of the casing gun are detonated and the casing has been perforated, the pressure of the formation immediately flows inwardly against the gun, turns uphole and then flows into the vents 28 and 42, where the flow is conducted uphole to the surface and into a pit where the hydrocarbons are flared until the well has been cleaned up. Thereafter, the well is tied into a gathering system.

In the above examples, at any time before the pins of the lower piston have been sheared, any of the above recited options can be exercised, rather than going ahead and completing the well by movement of the lower piston.

The present invention enables the simultaneous firing of the perforating gun, and communication of the perforated formation with ambient. The hydrostatic head of the fluids present in the lower annular area can be controlled to any predetermined desired value.

The perforating gun cannot inadvertently be fired by employing the present method, nor can debris accumulate above the firing head, thereby making the firing head inaccessible and necessitating the expensive employment of pulling equipment.

The present apparatus and method provides a safe, reliable and inexpensive means for completing a well in a manner which increases the well production as compared to other known well completion techniques.

I claim:

1. In a cased borehole having a packer device interposed between a tubing string and the casing to divide the casing annulus into an upper and lower annular area, and a perforating gun having a firing head arranged to be detonated by impact of an object circulated downhole through a borehole; the combination with said tubing and gun of well completion apparatus;

said apparatus includes an upper piston, upper vent ports formed in said tubing string, seal means by which said upper piston closes said upper ports, an axial passageway formed through said upper piston, a relatively large seat formed at the upper end of said upper piston;

a lower piston, an axial passageway formed through said lower piston and a relatively small seat formed at the upper end of the axial passageway of said lower piston;

small circulation ports formed in proximity of said firing head and below said lower piston;

means connected to said lower piston for engaging and detonating said firing head when said lower piston is moved downhole;

so that, a relatively large ball can be circulated downhole into seated relationship with respect to said upper piston to thereby move said piston downhole and open said upper ports; and, a relatively small ball can be circulated down the tubing string, through the axial passageway of the upper piston, into seated engagement with the seat of said lower piston, to thereby move said lower piston downhole while concurrently engaging said firing head and detonating said perforating gun, whereupon formation fluid can immediately flow from the formation, into the tubing string, and uphole to the surface of the ground.

2. The apparatus of claim 1 wherein intermediate ports are formed in said tubing string, seal means by which said lower piston closes said intermediate ports;

so that when said lower piston is moved downhole to fire the gun, the intermediate ports are simultaneously opened.

3. The apparatus of claim 2 wherein said upper and lower pistons are held in fixed relationship respective to the tubing string by shear pins;

so that when either of said pistons are forced downhole, the pins shear as the pistons are forced downhole within the tubing string.

4. The apparatus of claim 1 wherein said means connected to said lower piston for engaging and detonating said firing head is a downwardly depending shaft attached thereto in axially aligned relationship respective to said tubing string; and, said firing head has an upwardly extending trigger shaft arranged along the axial centerline of the tubing string so that when said lower piston is forced in a downward direction, the piston shaft contacts the trigger shaft which detonates the firing head.

5. In a cased wellbore having a tubing string extending downhole to perforating gun located adjacent to a hydrocarbon-bearing formation, said gun has a firing head which is detonated in response to impact, a packer means located uphole of the gun and dividing the casing annulus into an upper and lower annulus, the method of completing a well comprising forming upper, intermediate, and lower ports in said tubing string at a location below said packer means so that fluid flow can occur down the tubing string and through either of the three recited ports, when said ports are open; the lowermost port being placed adjacent to the firing head of the perforating gun;

covering the uppermost port with an upper piston and covering the intermediate port with a lower piston and sealing the interface between the outside of the piston and the inside of the tubing to preclude flow of fluid through said upper and intermediate ports;

forming an axial passageway through said upper piston and through said lower piston so that fluid flow can occur through said tubing string, through said upper and lower pistons, and through said lower port, and into said lower casing annulus;

forming a ball seat on each of said pistons at the upper end of each said axial passageway, and making the upper passageway relatively large in diameter respect to said lower passageway;

dropping a large ball down the tubing string so that the ball comes to rest seated on the upper piston thereby preventing access to said gun firing head;

circulating said large ball out of the tubing string and circulating a small ball down the tubing string, through the passageway of the upper piston, into seated position on the lower piston;

and applying pressure to the tubing interior until the lower piston moves downward;

using the downward movement of the lower piston for actuating said gun firing head to thereby detonate the gun and perforate said casing in proximity of said hydrocarbon bearing formation while simultaneously opening said intermediate set of ports.

6. In a slanted cased borehole having a casing gun located downhole in proximity of a hydrocarbon bearing formation with there being a tubing string extending from the surface to said gun; the method of completing the well according to the following steps:

providing the gun with a gun firing head which is detonated upon impact with an object moved downhole within the tubing string;

providing a tubing member series connected in the tubing string above the firing head;

deviating from vertical the longitudinal axis of the gun, firing head, and tubing member due to the slanted cased borehole so as to preclude dropping a weight through the tubing string to impact and actuate the firing head;

forming a circulating port in the tubing member so that fluid can be circulated downhole through the port to clean out debris located in proximity of the gun firing head;

slidably positioning a piston within the tubing member above the circulating port; and, forming an axial passageway longitudinally through the piston;

circulating fluid down through the tubing string, the axial passageway of the piston, and the circulating port to remove debris from about the firing head;

moving a ball downhole into sealed relationship respective to the passageway of the piston;

effecting internal tubing pressure at the surface of the ground to force said piston to move into engagement with the gun firing head to thereby detonate the gun and perforate the casing; and thereafter flowing hydrocarbons from the perforations, into the circulating port, and up through the tubing string, thereby completing the well.

7. In a cased borehole having a casing gun located downhole in proximity of a hydrocarbon bearing formation with there being a tubing string extending from a wellhead and connected to said gun; the method of completing the well according to the following steps:

providing said gun with a gun firing head which is detonated upon impact with an object forced downhole within the tubing string;

forming a circulating port in proximity of said gun firing head so that fluid can be circulated downhole through the port to clean out debris located in proximity of said gun firing head;

slidably positioning a piston within the tubing uphole of the circulating port; and, forming an axial passageway longitudinally through said piston;

forming an upper port in said tubing string at a location spaced above said piston; slidably mounting a second piston above the first recited piston and closing said upper port with said second piston; forming an axial passageway through the last said piston and making the last said passageway larger in diameter than the recited passageway formed through the lower piston so that a relatively large ball can be seated on the upper end of the uppermost piston, while a relatively small ball can be circulated downhole through the upper piston passageway and into sealed relationship with respect to the upper end of the passageway formed through the piston; thereby enabling the upper port to be uncovered by the use of a relatively large ball and for the gun to be fired by moving the lower piston with a relatively small ball;

circulating fluid down through the tubing string and through the axial passageways of the pistons to remove debris from about the firing head; and moving a ball downhole into sealed relationship respective to the passageway of said first recited piston and effecting internal tubing pressure at the surface of the ground to force said first recited piston to move into engagement with said gun firing head to thereby detonate the gun and perforate the casing, and thereafter flowing hydrocarbons from the perforations, into the circulating port, and up through the tubing string, thereby completing the well.

8. In a cased borehole having a casing gun located downhole in proximity of a hydrocarbon bearing formation with there being a tubing string extending from a wellhead and connected to said gun; the method of completing the well according to the following steps:

providing said gun with a gun firing head which is detonated upon impact with an object forced downhole within the tubing string;

forming a circulating port in proximity of said gun firing head so that fluid can be circulated downhole through the port to clean out debris located in proximity of said gun firing head;

slidably positioning a piston within the tubing uphole of the circulating port; and, forming an axial passageway longitudinally through said piston;

releasably connecting the tubing string together at a location above said piston; slidably positioning an upper annular piston within the tubing string and using the upper annular piston to hold the tubing string in the connected configuration;

said annular piston having an axial passageway which is larger than the passageway formed through the piston located therebelow;

circulating fluid down through the tubing string and through the axial passageways of the pistons to remove debris from about the firing head;

packing off the annulus between the casing and the tubing by employment of a packer device to thereby provide an upper and lower well annulus, locating the packer device above the location where the tubing string is releasably connected together;

circulating a relatively small ball downhole through the annular piston and into sealed relationship with the first recited piston passageway in order to carry out the step of firing the gun;

effecting internal tubing pressure at the surface of the ground to force said first recited piston to move into engagement with said gun firing head to thereby detonate the gun and perforate the casing, and thereafter flowing hydrocarbons from the perforations, into the circulating port, and up through the tubing string, thereby completing the well;

producing the well by flowing formation fluid from the formation, through the perforations, into the lower end of the tubing string, and to the surface of the ground;

circulating a ball downhole into engagement with the upper end of the passageway of the annular piston, forcing the annular piston to move downhole, and using the downhole movement of the annular piston to release the lower tubing string at the recited location above the first recited piston.

9. In a cased borehole having a casing gun located downhole in proximity of a hydrocarbon bearing formation with there being a tubing string extending from a wellhead and connected to said gun; the method of completing the well according to the following steps:

providing said gun with a gun firing head which is detonated upon impact with an object forced downhole within the tubing string;

forming a circulating port in proximity of said gun firing head so that fluid can be circulated downhole through the port to clean out debris located in proximity of said gun firing head;

slidably positioning a piston within the tubing uphole of the circulating port; and, forming an axial passageway longitudinally through said piston;

placing a second piston above the first recited piston, orming a lateral flow port in the tubing and covering the port with the second piston; forming an axial passageway through said second piston which is larger than the pasageway through the first piston;

circulating fluid down through the tubing string and through the axial passageway of the piston to remove debris from about the firing head;

moving a relatively large ball downhole into seated relationship respective to the upper end of the passageway of the second piston, thereby isolating the lower piston;

circulating the ball out of the hole, and moving another ball downhole into seated relationship respective to the upper end of the passageway of the lower piston;

increasing the tubing pressure, causing the lower piston to move downhole, thereby detonating the gun, and perforating the casing of the well bore.

10. A well completion apparatus mounted on a pipe string extending into a slanted cased borehole comprising:

a perforating gun having a firing head and disposed on the pipe string in proximity of a hydrocarbon formation;

a tubular member series connected in the pipe string above said firing head;

said tubular member, firing head and perforating gun having their longitudinal axis substantially deviated from vertical due to the slanted cased borehole so as to preclude dropping a weight through the pipe string to impact and actuate said firing head;

vent means in said tubular member for opening the tubing string to fluid flow prior to the detonation of the perforating gun;

a piston reciprocably mounted within said tubular member and having an axial flow passageway formed therethrough;

circulation ports formed in said tubular member below said piston; and a ball circulated downhole through the pipe string for sealing said axial flow passageway whereby fluid pressure is applied to said piston causing said piston to engage said firing head and detonate said perforating gun.

11. The well completion apparatus of claim 10 and further including means for sealing said piston with the interior of said tubular member.

12. The well completion apparatus of claim 10 and further including shear means for supporting said piston within said tubular member in a predetermined position and being sheared upon the application of said fluid pressure.

13. The well completion apparatus of claim 10 and further including projection means projecting from said piston for engagement with the firing head to move the firing head into detonating position.

14. The well completion apparatus of claim 10 wherein said vent means includes vent ports through said tubular member for permitting the flow of production fluids into the tubing string after detonation of the perforating gun, said vent ports being closed by said piston until said piston moves into engagement with said firing head.

15. The well completion apparatus of claim 10 and further including release means for releasing the perforating gun from the pipe string.

16. The well completion apparatus of claim 15 wherein said release means includes detent means connecting the gun to the pipe string and a barrier actuated by fluid pressure for releasing said detent means.

17. The well completion apparatus of claim 10 wherein said vent means includes a vent assembly disposed above said piston, said vent assembly having flow ports for fluid circulation between the interior of the pipe string and the annulus around the pipe string.

18. The well completion apparatus of claim 17 wherein said vent assembly includes a barrier for closing said flow ports.

19. The well completion apparatus of claim 10 and further including means disposed in the pipe string above said piston for preventing debris from falling through said tubular member to collect around the firing head.

20. The well completion apparatus of claim 10 and further including release means for detaching the perforating gun from the pipe string, and, selective means for selectively actuating said vent means, said release means or said piston.

21. The well completion apparatus of claim 20 wherein said selective means includes a first sphere larger than said ball for closing an axial flow channel through said vent means and a second sphere larger than said first sphere for closing an axial flow passage through said release means.

22. In a cased wellbore having a tubing string extending from the surface downhole to a perforating gun located adjacent to a hydrocarbon bearing formation, the gun having a firing head which is detonated in response to impact, a packer means located uphole of the gun and dividing the casing annulus into an upper and lower annulus, the method of completing the well comprising:

forming a circulation port in proximity of the gun firing head so that fluid can be circulated downhole through the circulation port to flush out debris located in proximity of the gun firing head;

slidably positioning an actuator piston within the tubing string above the circulation port and forming an axial passageway longitudinally through the actuator piston so that fluid flow can occur through the actuator piston and circulation port;

forming a ball seat on the actuator piston at the upper end of the axial passageway for seating the actuator ball to seal that portion of the tubing string above the actuator piston to fluid flow;

forming a vent port in the tubing string at a location below the packer means and above the actuator piston so that fluid flow can occur between the string and wellbore annulus;

covering the vent port with a slidable vent piston to preclude fluid flow through the vent port and forming an axial bore longitudinally through the vent piston with the axial bore being sized to pass the actuator ball therethrough;

forming a ball seat on the vent piston at the upper end of the axial bore for seating a vent ball to seal that portion of the tubing string above the vent piston to fluid flow;

circulating fluid down through the tubing string, the axial bore, the axial passageway and the circulation port to remove debris located in proximity of the gun firing head;

moving the actuator ball downhole through the axial bore of the vent piston and into sealed relationship with the actuator piston at the ball seat;

effecting internal tubing pressure at the surface to force the actuator piston to move into engagement with the gun firing head;

detonating the perforating gun and perforating the cased borehole; and flowing hydrocarbons from the hydrocarbon producing formation, through the perforations, the circulation port and up the tubing string to the surface, thereby completing the well.

23. The method of claim 22 and including after the step of moving the actuator ball downhole, the step of dropping the vent ball down the tubing string and into sealed relationship with the vent piston at the ball seat so that upon effecting tubing pressure at the surface, the vent piston also moves downwardly to open the vent port where, upon completion of the well, hydrocarbons can also flow into the tubing string through the vent port.

24. The method of claim 23 and further including forming production ports in the tubing string which are covered by the actuator piston, opening the production ports upon the downward movement of the actuator piston, and flowing hydrocarbons through the production ports upon perforating the well.

25. The method of claim 23 and further including the step of:

releasably connecting the tubing string together at a location above the vent piston; slidably positioning an upper annular piston within the tubing string and using the upper annular piston to hold the tubing string in the connected configuration;

forming an axial passageway in the annular piston which is larger than the axial bore formed through the vent piston located therebelow;

circulating a ball downhole into engagement with the upper end of the passageway of the annular piston, forcing the annular piston to move downhole, and using the downhole movement of the annular piston to release the lower tubing string at the recited location above the vent piston.

26. The method of claim 22, further including prior to the step of circulating to remove debris, the steps of:

moving the vent ball downhole into sealed relationship with the vent piston at the ball seat; and maintaining the vent ball and piston in sealed relationship until it is desired to complete the well.

27. The method of claim 26, and further including the steps of reverse circulating down the wellbore annulus and up the tubing string to carry the vent ball back to the surface.

28. The method of claim 26, and further including the step of effecting internal tubing pressure at the surface to force the vent piston to open the vent port of fluid flow.

29. The method of claim 28, and further including the steps of removing the vent ball from the tubing string and repositioning the vent piston with a fishing tool to close the vent port.

30. The method of claim 29, and including after the step of moving the actuator ball downhole, the step of dropping the vent ball down the tubing string and into sealed relationship with the vent piston at the ball seat so that upon effecting tubing pressure at the surface, the vent piston also moves downwardly to pen the vent port where, upon completion of the well, hydrocarbons can flow into the tubing string through the vent port.

31. In a cased wellbore having a tubing string extending from the surface downhole to a perforating gun located adjacent to a hydrocarbon-bearing formation, the gun having a firing head which is detonated in response to impact, a packer means located uphole of the gun and dividing the casing annulus into an upper and lower annulus, the method of completing the well comprising:

forming a circulation port in proximity of the gun firing head so that fluid can be circulated downhole through the circulation port to flush out debris located in proximity of the gun firing head;

slidably positioning an actuator piston within the tubing string above the circulation port and forming an axial passageway longitudinally through the actuator piston so that fluid flow can occur through the actuator piston and circulation port;

forming a ball seat on the actuator piston at the upper end of the axial passageway for seating an actuator ball to seal that portion of the tubing string above the actuator piston to fluid flow;

forming a vent port in the tubing string at a location below the packer means and above the actuator piston so that fluid flow can occur between the tubing string and wellbore annulus;

covering the vent port with a slidable vent piston to preclude fluid flow through the vent port and forming an axial bore longitudinally through the vent piston with the axial bore being sized to pass the actuator ball therethrough;

forming a ball seat on the vent piston at the upper end of the axial bore for seating a vent ball to seal that portion of the tubing string above the vent piston to fluid flow;

circulating fluid down through the tubing string, the axial bore, the axial passageway and the circulation port to remove debris located in proximity of the gun firing head;

moving the actuator ball downhole through the axial bore of the vent piston and into sealed relationship with the actuator piston at the ball seat;

moving the vent ball downhole into sealed relationship with the vent piston at the ball seat;

effecting internal tubing pressure at the surface to simultaneously force the vent and actuator pistons downwardly to open the vent port and move the actuator piston into engagement with the gun firing head;

detonating the perforating gun and perforating the cased borehole; and flowing hydrocarbons from the hydrocarbon producing formation, through the perforations, the circulation and vent ports and up the tubing string to the surface, thereby completing the well.

32. The method of claim 31 and further including forming production ports in the tubing string which are covered by the actuator piston, opening the production ports upon the downward movement of the actuator piston, and flowing hydrocarbons through the production ports upon perforating the well.

33. The method of claim 31 and further including the steps of:

releasably connecting the tubing string together at a location above the vent piston; slidably positioning an upper annular piston within the tubing string and using the upper annular piston to hold the tubing string in the connected configuration;

forming an axial passageway through the annular piston with the axial passageway being larger than the axial bore formed through the vent piston located therebelow; and, circulating a ball downhole into engagement with the upper end of the passageway of the annular piston, forcing the annular piston to move downhole, and using the downhole movement of the annular piston to release the lower tubing string at the recited location above the vent position.

34. In a cased wellbore having a tubing string extending from the surface downhole to a perforating gun located adjacent to a hydrocarbon bearing formation, the gun having a firing head which is detonated in response to impact, a packer means located uphole of the gun and dividing the casing annulus into an upper and lower annulus, the method of completing the well comprising:

forming a circulation port in proximity of the gun firing head so that fluid can be circulated downhole through the circulation port to flush out debris located in proximity of the open firing head;

slidably positioning an actuator piston within the tubing string above the circulation port and forming an axial passageway longitudinally through the actuator piston so that fluid flow can occur through the actuator piston and circulation port;

forming a ball seat on the actuator piston at the upper end of the axial passageway for seating an actuator ball to seal that portion of the tubing string above the actuator piston to fluid flow;

forming a vent port in the tubing string at a location below the packer means and above the actuator piston so that fluid flow can occur between the tubing string and wellbore annulus;

covering the vent port with a slidable vent piston to preclude fluid flow through the vent port and forming an axial bore longitudinally through the vent piston with the axial bore being sized to pass the actuator ball therethrough;

forming a ball seat on the vent piston at the upper end of the axial bore for seating a vent ball to seal that portion of the tubing string above the vent piston to fluid flow;

moving the vent ball downhole into sealed relationship with the vent piston at the ball seat;

effecting internal tubing pressure at the surface to force the vent piston to open the vent port to fluid flow;

dropping a bar down the tubing string to impact the vent piston which engages the actuator piston to move the actuator piston into engagement with the gun firing head;

detonating the perforating gun and perforating the cased borehole and, flowing hydrocarbons from the hydrocarbon producing formation, through the perforations, the circulation port and up the tubing string to the surface, thereby completing the well.

* * * * *